US008378561B2

(12) United States Patent
Ishiguro et al.

(10) Patent No.: US 8,378,561 B2
(45) Date of Patent: Feb. 19, 2013

(54) ELECTRON EMITTER AND FIELD EMISSION DEVICE PROVIDED WITH ELECTRON EMITTER

(75) Inventors: Yoshihisa Ishiguro, Tokyo (JP); Masanori Haba, Machida (JP); Ryouichi Suzuki, Tsukuba (JP)

(73) Assignee: Life Technology Research Institute, Inc., Tokyo (JP)

( * ) Notice: Subject to any disclaimer, the term of this patent is extended or adjusted under 35 U.S.C. 154(b) by 0 days.

(21) Appl. No.: 13/055,560

(22) PCT Filed: Jul. 30, 2009

(86) PCT No.: PCT/JP2009/063563

§ 371 (c)(1),
(2), (4) Date: Jan. 24, 2011

(87) PCT Pub. No.: WO2010/013772

PCT Pub. Date: Feb. 4, 2010

(65) Prior Publication Data

US 2011/0115363 A1 May 19, 2011

(30) Foreign Application Priority Data

Jul. 31, 2008 (JP) ..... 2008-198809
Jan. 9, 2009 (JP) ..... 2009-003713

(51) Int. Cl.
*H01J 63/04* (2006.01)

(52) U.S. Cl. ..... 313/310

(58) Field of Classification Search ..... 313/309–310
See application file for complete search history.

(56) References Cited

U.S. PATENT DOCUMENTS

| | | | | |
|---|---|---|---|---|
| 6,307,309 | B1 | 10/2001 | Okamoto et al. | |
| 6,972,513 | B2 | 12/2005 | Shiratori et al. | |
| 2004/0012327 | A1 | 1/2004 | Shiratori et al. | |
| 2005/0037150 | A1* | 2/2005 | Iijima et al. | 427/446 |
| 2006/0192476 | A1* | 8/2006 | Wei et al. | 313/495 |
| 2006/0255344 | A1* | 11/2006 | Choi et al. | 257/82 |

FOREIGN PATENT DOCUMENTS

| | | | |
|---|---|---|---|
| JP | 2000-100317 | A | 4/2000 |
| JP | 2000-133117 | A | 5/2000 |
| JP | 2002-093307 | A | 3/2002 |
| JP | 2002-100282 | A | 4/2002 |
| JP | 2003-16915 | A | 1/2003 |
| JP | 2007-179874 | A | 7/2007 |
| JP | 2008-150253 | A | 7/2008 |
| JP | 2008-150682 | A | 7/2008 |

* cited by examiner

*Primary Examiner* — Anh Mai
*Assistant Examiner* — Hana Featherly
(74) *Attorney, Agent, or Firm* — Foley & Lardner LLP

(57) ABSTRACT

An electron emitter includes a guard electrode 13 on the outer circumferential side of a carbon film structure 10 which is formed on a substrate 7 by plasma CVD method. This guard electrode 13 includes a curved surface portion (a curved surface portion that curves from top toward a side opposite to the film-forming direction) 13*a* convex in a film-forming direction of the carbon film structure 10. A curvature radius R1 of an outer-circumferential-side portion of the curved surface portion 13*a* is larger than or equal to a curvature radius R2 of a carbon-film-structure-side portion of the curved surface portion 13*a*.

8 Claims, 6 Drawing Sheets

ELECTRON EMITTER AND FIELD EMISSION DEVICE PROVIDED WITH ELECTRON EMITTER

TECHNICAL FIELD

The present invention relates to an electron emitter and a field emission device equipped with the electron emitter, which are applied to various equipments such as an electron tube, an illuminating system and an X-ray system.

BACKGROUND ART

A field emission is a phenomenon in which electrons are emitted into a vacuum by means of electric-field concentration. As an electron emitter for generating this field emission, for example, a carbon nanotube has attracted attention. Since this carbon nanotube is extremely narrow and has a high-aspect ratio, the carbon nanotube has a superior field emission characteristic. Hence, the carbon nanotube is thought to be able to produce a field-electron emission element. Accordingly, it has been considered that the carbon nanotube is applied to various field emission devices such as the electron tube and the illuminating system.

The field emission characteristic (IV characteristic) is shown by a curved line representing a relation between a voltage V and a field emission current (emitted current) I when an electric field is emitted from a cold cathode by applying the voltage V between the cold cathode and an anode. This field emission characteristic (IV characteristic) is characterized by a voltage value (threshold value) for starting the field emission, and gradient and shape of the curved line.

As a concrete example of the field emission device, a cold cathode fluorescent lamp can be cited in which the above-mentioned cold cathode is disposed to face an anode provided with a fluorescent material. In the cold cathode fluorescent lamp, electrons are made to be emitted by field emission from the cold cathode by generating a voltage (anode-to-cathode voltage) between the cold cathode and the anode, and these emitted electrons are accelerated and collided to the fluorescent material so as to excite the fluorescent material to become luminous. This luminescence (light emission) of fluorescent material needs a predetermined amount of electron emission. The current-voltage (I-V) characteristic curve having a vertical axis representing an emission current corresponding to an amount of electron emission and a lateral axis representing the anode-to-cathode voltage means an electron emitting performance of the cold cathode. In the case of carbon nanotube, the gradient of the above-mentioned I-V characteristic curve starts to rise moderately. Hence, in the case of carbon nanotube, a voltage V necessary to obtain the emission current value for starting the luminescence (light emission) of fluorescent material is relatively high.

However, since a value of the applied voltage V for obtaining a desired emission current is large; a characteristic of the carbon nanotube itself is changed (deteriorates), and also, a voltage necessary to obtain a certain current becomes high. Therefore, for example, there are a problem that a power-supply facility for this high voltage is required and a problem that a production of the cold cathode fluorescent lamp is affected. Accordingly, it has been awaited to realize a carbon film for cold cathode which provides an I-V characteristic that can obtain an emission current capable of causing the fluorescent material to start to become luminous with a relatively low applied voltage V.

In recent years, a carbon film structure which is formed by dispersing a plurality of acute shapes (i.e., countless number of acute shapes are dispersed) on a surface of substrate, has been developed by the inventor of the present application, etc., instead of the carbon nanotube or the like. Each of the plurality of acute shapes is formed by piling graphene sheets in a multilayer manner to have an inside hollow portion, and has a radius which becomes smaller as its tip approaches. That is, this carbon film structure is constructed by forming a plurality of carbon film aggregation units on the substrate. Each of these carbon film aggregation units includes a stem-shaped carbon film and a branch-shaped carbon film group. This branch-shaped carbon film group is formed to surround the stem-shaped carbon film from the middle of the stem-shaped carbon film to a lower portion of the stem-shaped carbon film. The stem-shaped carbon film is formed with the inside hollow portion by the multi-piled graphene sheets, and is formed in the acute shape reducing its radius toward its tip end (for example, such a structure is disclosed by Patent Documents 1 and 2). An emitter having such a carbon film structure can obtain a desired emission current with a lower applied-voltage as compared with the carbon nanotube and the like, because of the existence of the acicular acute shapes whose radius is reduced toward its tip. Therefore, the emitter having the above-mentioned carbon film structure is thought to be able to provide a field emission device having a superior performance in I-V characteristic.

FIG. 7 is a schematic view showing a film-forming apparatus that uses a plasma CVD method (direct-current plasma film-forming method), as one example of a system for forming the carbon film structure. As shown in FIG. 7, a vacuum film-forming chamber 1 is equipped with a gas introducing system 2 (for example, an introducing system for a gas mixture of a hydrogen gas and a gas containing carbon (e.g., methane gas)) and an evacuating system 3. Inside the vacuum film-forming chamber 1, a cathode 4 (an electrode including an insulation cooling plate 4*a* for controlling a cathode temperature) and an anode 5 are disposed to face each other. A reference sign 6 denotes a direct-current power source. A negative pole side of the direct-current power source 6 is connected with the cathode 4. A positive pole side of the direct-current power source 6 and the anode 5 are respectively grounded.

As to such a film-forming apparatus, at first, the evacuating system 3 evacuates the vacuum film-forming chamber 1. Then, the gas introducing system 2 introduces the gas (hydrogen gas) and gradually controls a pressure of the vacuum film-forming chamber 1 (for example, to about 30 torr). An electric current is maintained at a desired level (for example, about 2.5 A). Thereby, oxides on the substrate 7 are eliminated.

Next, the gas introducing system 2 introduces the gas mixture into the vacuum film-forming chamber 1 so as to gradually increase the internal pressure of the vacuum film-forming chamber 1, and then, maintains the internal pressure of vacuum film-forming chamber 1 (for example, at about 75 torr). The current of direct-current power source 6 is gradually increased and maintained (for example, at about 6 A).

Accordingly, the temperature of substrate 7 becomes equal to a predetermined temperature (for example, about 900° C. to 1150° C.) by plasma 8 generated on the substrate 7. Thereby, the gas containing carbon which is included in the above-mentioned gas mixture is decomposed so that the carbon film structure (reference sign 10 in an after-mentioned FIG. 8) is formed on a surface of the substrate 7. In the case that the carbon film structure is formed in this manner, a mask (not shown) may be suitably used for the substrate 7.

FIG. 8 is a schematic explanatory view in the case that an electron emitter including the carbon film structure formed as mentioned above is used as the cold cathode. As shown in FIG. 8, at first, an electrode surface (upper surface in FIG. 8) of cold cathode 9 which is located on the side of carbon film structure 10 and an electrode surface (lower surface in FIG. 8) of anode 11 are disposed to face each other (i.e., the respective electrode surfaces are arranged parallel to each other). Then, when a direct-current power source 12 applies a constant voltage between the both electrodes, tunnel electrons shown by a Fowler-Nordheim formula are emitted from the cold cathode 9 into the anode 11, by a strong electric field formed at the carbon film structure 10 (in particular, at the tip of each acute shape). An electron emission characteristic in this case is shown by FIG. 9. It is preferable that an emission direction of electron is perpendicular to the electrode surface of cold cathode 9.

However, as to the electron emitter including the above-mentioned carbon film structure, a growth direction or a shape (size, thickness and the like) of each acute shape of this carbon film structure is difficult to equalize. In particular, in the case that the carbon film structure is formed by using the mask for the substrate, a relatively thick and dense portion of carbon film structure is formed around the mask (for example in the case of FIG. 8, at an outer circumferential edge portion of the carbon film structure 10).

Therefore, if a field emission device equipped with the cold cathode simply including the above-mentioned carbon film structure is used, the emission direction of electron deviates from the direction perpendicular to the cold cathode surface (i.e., electrons are emitted in various directions so as to be dispersed as shown by broken lines of FIG. 8). Thereby, a region of electron flow between the cold cathode and the anode is expanded. Hence, an electron spot in the anode becomes large and uneven (for example in the case of FIG. 8, the electron spot of the anode 11 is larger than an area of the electrode surface of cold cathode 9 and is inhomogeneous as compared to the electrode surface of cold cathode 9). Accordingly, it is difficult to obtain a high current density, so that a large and stable current is not obtained.

Moreover, in the case of the above-mentioned relatively thick and dense carbon film structure, a localized electric-field concentration is easy to cause. Hence, equipotential surfaces protrude at this region of localized electric-field concentration. Thereby, a large quantity of electrons are emitted to cause a current degradation due to thermal degradation or to cause an electric-discharge phenomenon due to charge-up and subsequent insulation breakdown to structural members existing around the cold cathode.

When trying to attain a desired function (for example, a function as electron-beam source) by applying the above-explained emitter to a field emission device, large-scaled power source and various types of equipments and the like are necessary. Thus, it has been difficult to obtain a practical-level product (for example, a compact and low-cost product).

CITATION LIST

Patent Document

Patent Document 1: Japanese Patent Application Publication No. 2008-150253

Patent Document 2: Japanese Patent Application Publication No. 2008-150682

SUMMARY OF THE INVENTION

Technical Problem

As understood from the above explanations, in an emitter of field-emission electron which includes a carbon film structure, the localized electric-field concentration is required to be suppressed and the current degradation and the electric-discharge phenomenon which accompany the thermal degradation are required to be prevented. Moreover, the dispersion of electron emission is required to be suppressed.

Moreover, in a field emission device equipped with the emitter, a product which can attain a desired function and which is more practical is required to be realized.

Solution to Problem

In order to solve the above problem, according to the present invention, an electron emitter is characterized in that the electron emitter comprises: a carbon film structure formed on a surface of a substrate, wherein the carbon film structure includes a plurality of acute shapes dispersed in the carbon film structure, wherein each of the acute shapes is formed by multilayered graphene sheets to have an inside hollow portion and has a radius reduced more toward a tip of the each acute shape; and a guard electrode provided on an outer circumferential side of the carbon film structure, wherein the guard electrode includes a curved surface portion convex in a film-forming direction of the carbon film structure and has an electric potential equivalent to at least one of the carbon film structure and the substrate.

As another aspect of the electron emitter, the curved surface portion of the guard electrode has an outer-circumferential-side portion and a carbon-film-structure-side portion, and a curvature radius of the outer-circumferential-side portion is larger than or equal to a curvature radius of the carbon-film-structure-side portion.

As still another aspect of the electron emitter, a top portion of the curved surface portion of the guard electrode protrudes in the film-forming direction beyond an outer circumferential edge portion of the carbon film structure.

As still another aspect of the electron emitter, the surface of the substrate on which the carbon film structure is formed is formed in a concave shape.

Moreover, as a field emission device using any one of the above aspects of the electron emitter, the field emission device comprises: a cold cathode including an electron emitter having a carbon film structure formed on a substrate surface; and an anode disposed to cause an electrode surface of the anode to face an electrode surface of the cold cathode, wherein the field emission device is configured to emit electrons from the cold cathode by way of field emission, by applying a voltage between the cold cathode and the anode.

As another aspect of the field emission device, the field emission device further comprises a focusing electrode disposed between the cold cathode and the anode, and the focusing electrode is configured to introduce the electrons emitted from the cold cathode in a direction toward the anode and configured to focus an electron-flow region existing between the cold cathode and the anode.

As still another aspect of the field emission device, the cold cathode, the anode and the focusing electrode are arranged to satisfy the following formula: (a distance between the cold cathode and the focusing electrode)/(a distance between the cold cathode and the anode)=0.1~0.5. More preferably, 0.15~about 0.44.

Advantageous Effects of the Invention

As mentioned above, according to the present invention, the localized electric-field concentration can be suppressed and the electric-current degradation or the electric-discharge phenomenon due to the thermal deterioration can be prevented from occurring, in an emitter of field-emission electron that includes a carbon film structure.

Moreover, in a field emission device to which the emitter has been applied, a desired function can be achieved so that a more practical product can be provided.

DESCRIPTION OF EMBODIMENTS

Figure 8:
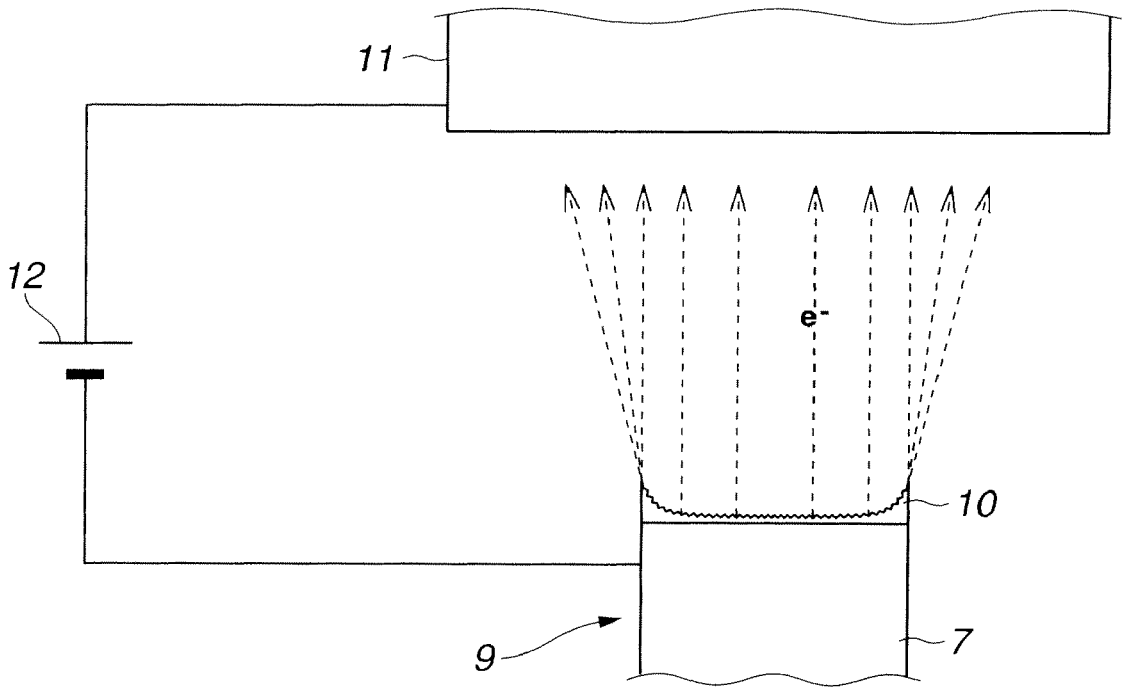
FIG. 8 A schematic explanatory view of a general field emission device using an electron emitter including a carbon film structure.
Figure 9:
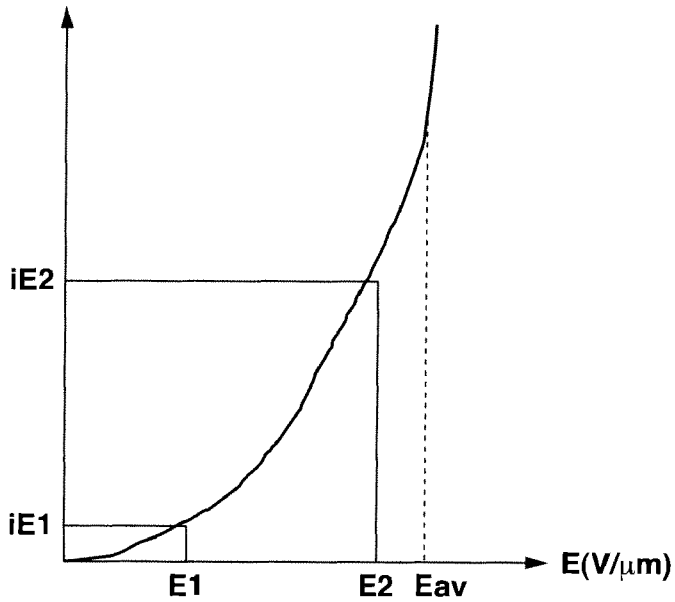
FIG. 9 A view showing an electron emission characteristic of the field emission device.

Hereinafter, the present invention will be explained in detail based on embodiments and the like of an emitter of field-emission electron and a field emission device. Components similar to FIG. 8 are, for example, given reference signs same as those of FIG. 8, and detailed explanations thereof will be omitted properly for the purpose of simplification of the disclosure.

The present invention has been developed by discovering that a localized electric-field concentration (local buildup of electric field) which is possibly caused in a carbon film structure (particularly, at an outer circumferential edge portion of the carbon film structure) formed on a surface of substrate (for example, by a plasma CVD method) is suppressed by the following treatments to the carbon film structure. That is, a guard electrode (for example, a guard electrode abutting on and electrically connected with the carbon film structure) having an electric potential equivalent to that of the carbon film structure and/or that of the substrate is provided on an outer circumferential side of the carbon film structure, so that an apparent curvature radius (totally-taken curvature radius) of a circumference of the carbon film structure is enlarged.

The above-mentioned guard electrode for enlarging the apparent curvature radius of the circumferential portion of carbon film structure includes a curved surface portion that protrudes in a film-forming direction of the carbon film structure (i.e., includes a curved surface portion that curves from its top in a direction opposite to the film-forming direction). The curved surface portion of guard electrode has a curvature radius of an outer circumferential side of the guard electrode, and has a curvature radius of a portion of the guard electrode which is located on a side of the carbon film structure. The curvature radius of the outer circumferential side of guard electrode is larger than or equal to the curvature radius of the guard electrode's portion located on the side of carbon film structure. Specifically, for example, the curved surface portion of guard electrode has its curvature radius which is increased more with an approach from the side of carbon film structure toward the outer circumferential side of guard electrode. Alternatively, the curved surface portion of guard electrode has a constant curvature radius (for example, a cross section of the guard electrode (i.e., a cross section of ring-shaped guard electrode which is taken along an axial direction of this ring-shaped guard electrode) is shaped like a perfect circle as shown in FIG. 1C).

As a concrete example, as shown by a schematic view of FIG. 1A, the curved surface portion 13*a* of the guard electrode 13 is provided to the carbon film structure 10 which includes the outer circumferential edge portion 10*a* formed to be thickened and curved (the outer circumferential edge portion 10*a* is curved at a curvature radius R0 in the figures (a reference sign L0 denotes a tangent of the curved surface having the curvature radius R0)). The curved surface portion 13*a* of guard electrode 13 includes a portion which is located on the side of carbon film structure 10 and which has a curvature radius R1, and a portion which is located in the outer circumferential side of guard electrode 13 and which has a curvature radius R2. These curvature radiuses R1 and R2 satisfy a relational expression of $R1 \leqq R2$.

Figure 1:
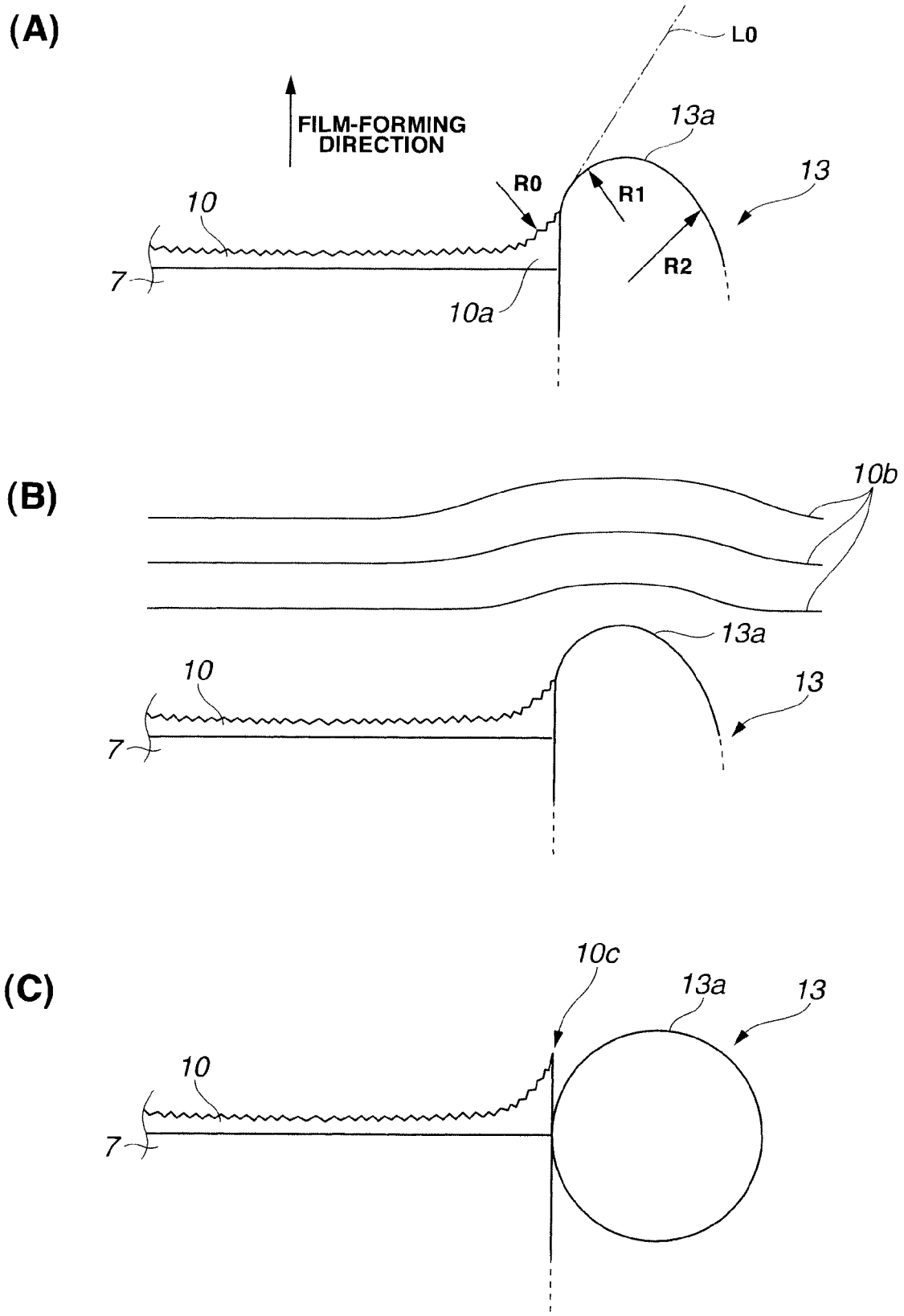
FIG. 1 A schematic explanatory view of an emitter of field-emission electron and a field emission device according to the present invention.

Therefore, the guard electrode according to the present invention is not limited to the shapes as shown in FIG. 1. That is, various shapes can be employed as the shape of guard electrode according to the present invention, if each of the various shapes includes its curved surface portion protruding in the film-forming direction of carbon film structure and is provided on the outer circumferential side of carbon film structure so as to increase the apparent curvature radius of periphery of the carbon film structure. In the case that such a guard electrode 13 is provided, equipotential surfaces are formed in a relatively flat shape as shown by a reference sign 10*b* of FIG. 1B.

It is preferable that a clearance or the like does not exist between the carbon film structure 10 and the guard electrode 13 as shown in FIGS. 1A and 1B. However, for example, even if a clearance 10*c* exists between the carbon film structure 10 and the guard electrode 13 because of the provision of an approximately ring-shaped guard electrode 13 as shown in FIG. 1C, the equipotential surfaces are formed sufficiently flat at least as compared with the case shown in FIG. 8, for example as long as a top of the curved surface portion 13*a* protrudes beyond the carbon film structure 10 (for example, beyond a top of acute shape of the outer-circumferential edge portion of carbon film structure 10) in the film-forming direction and also the clearance 10*c* is minute.

As the substrate according to the present invention, various kinds of substrates (for example, a substantially disc-shaped Si substrate, a substantially plate-rectangular Si substrate, a SUS substrate or the like) can be used as long as the carbon film structure can be formed on those substrates. For example, in a case of substantially rectangular substrate, the guard electrode is provided to an outer circumferential side of a carbon film structure formed on the substantially-rectangular substrate so that an apparent curvature radius of a circumference of the carbon film structure is enlarged. Moreover, according to the present invention, the surface of a side of the substrate on which the carbon film structure is formed is not limited to a flat surface, but for example, may be a surface curved in a concave shape.

According to the present invention, the carbon film structure and the substrate can be used under a state whether the carbon film structure has been merely formed on the substrate. Alternatively, for example, the carbon film structure and the substrate may be used under a state where a surface of the carbon film structure has been properly ground (for example in FIG. 1, the top portion of outer circumferential edge portion 10*a* is ground). However, if grinding the carbon film structure excessively, the acute shapes of the carbon film structure are reduced so that there is a risk that a characteristic of the carbon film structure is seriously damaged.

[First Embodiment]

Figure 2:
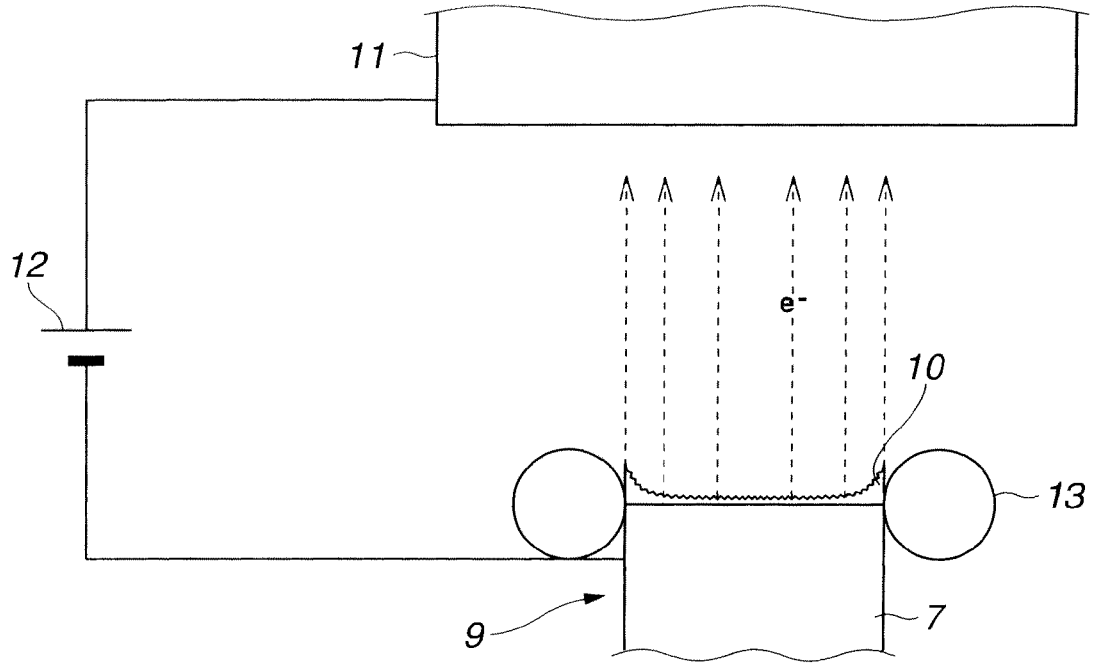
FIG. 2 A schematic explanatory view of an emitter of field-emission electron and a field emission device according to a first embodiment.

FIG. 2 is a schematic view for explaining one example of the emitter of field-emission electron and the field emission device in a first embodiment according to the present invention. As shown in FIG. 2, the guard electrode 13 having an electric potential equivalent to that of the carbon film structure 10 and/or the substrate 7 is provided to the outer circumferential side of carbon film structure 10 (to the outer circumferential edge portion of carbon film structure 10 in the case of FIG. 1) formed in the substrate 7 of a cold cathode (negative electrode) 9.

By virtue of this guard electrode 13, the apparent curvature radius of the circumference of carbon film structure 10 is increased. Hence, the electric-field concentration which can occur at the outer circumferential edge portion of carbon film structure 10 is suppressed. For example, as compared with the case that the guard electrode 13 is not provided (e.g., in the case of FIG. 8), a region of electron flow between the cold cathode 9 and an anode (positive electrode) 11 does not expand. Hence, an electron spot in the anode 11 is equal to an area (dimensions) of electrode surface of the cold cathode 9, and has an even electron distribution (i.e., an inhomogeneous state of electron-reaching distribution shown in FIG. 8 is eased). Accordingly, a higher electric current density can be obtained.

[Second Embodiment]

Figure 3:
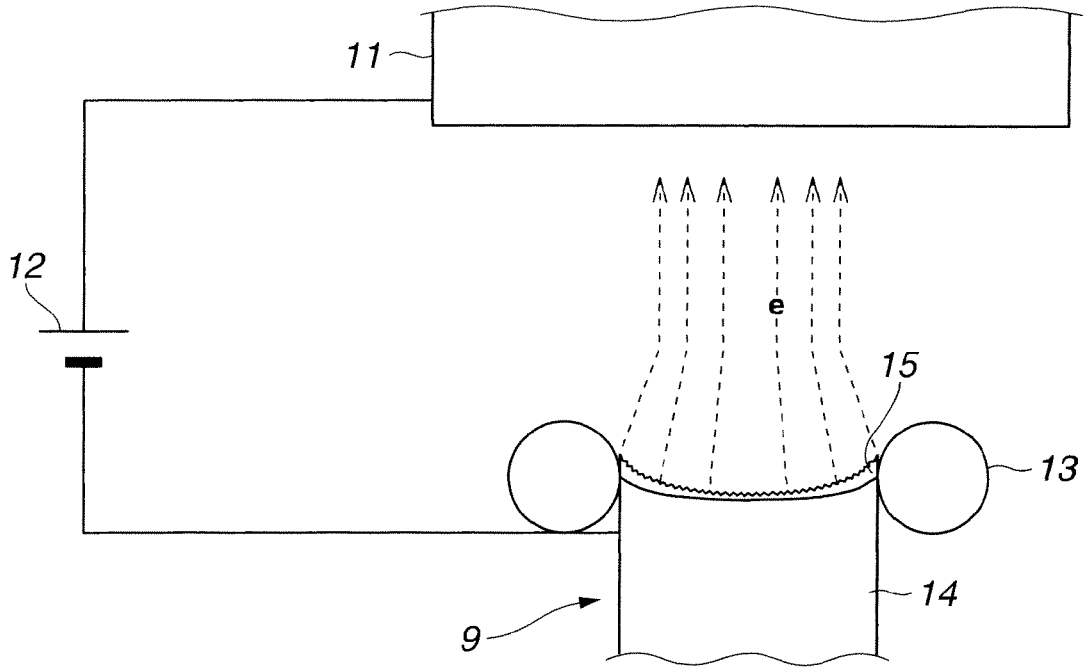
FIG. 3 A schematic explanatory view of an emitter of field-emission electron and a field emission device according to a second embodiment.

FIG. 3 is a schematic view for explaining one example of the emitter of field-emission electron and the field emission device in a second embodiment according to the present invention. The cold cathode 9 shown in FIG. 3 includes the substrate 14 having an electrode-surface-side portion (i.e., a surface onto which the carbon film structure is formed) formed in a concave shape (i.e., a middle portion of electrode surface is depressed to have a curvature radius).

The carbon film structure 15 formed on such a substrate 14 includes an outer circumferential edge portion formed in a concave shape largely curved relative to a direction toward the anode 11, as compared with the case of the carbon film structure formed on the flat electrode surface of substrate (for example, the carbon film structure 10 of FIG. 2). That is, the region of electron flow between the cold cathode 9 and the anode 11 is more focused (converges) as the anode 11 approaches. Accordingly, the electron spot of the anode 11 is smaller than the area of the electrode surface of cold cathode 9 and has an even distribution, so that a higher electric current density can be obtained.

[Third Embodiment]

Figure 4:
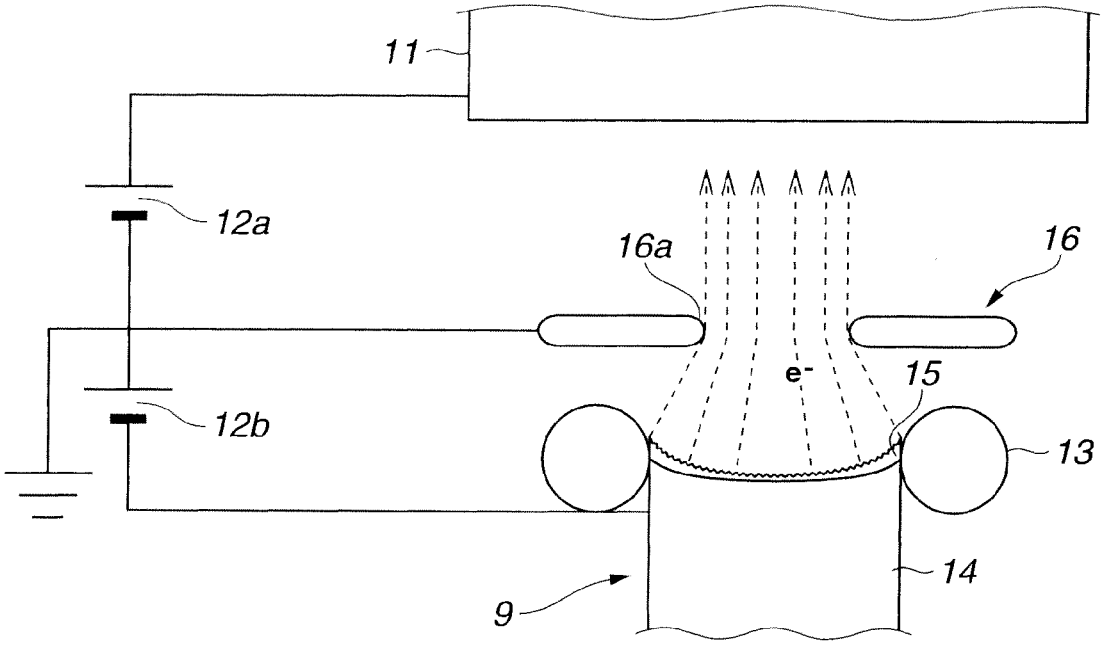
FIG. 4 A schematic explanatory view of an emitter of field-emission electron and a field emission device according to a third embodiment.

FIG. 4 is a schematic view for explaining one example of the emitter of field-emission electron and the field emission device in a third embodiment according to the present invention. In FIG. 4, a reference sign 16 denotes a focusing electrode formed with an opening hole portion 16*a* through which electrons emitted from the cold cathode 9 pass. The focusing electrode 16 is located between the cold cathode 9 and the anode 11, and functions to derive the electrons in the direction toward the anode 11. An opening area of the opening hole portion 16*a* is smaller than the electrode area of the cold cathode 9, so that the focusing electrode 16 can block a part of the electron-flow region existing between the cold cathode 9 and the anode 11.

By means of the provision of such a focusing electrode 16, electrons capable of being emitted from the outer circumferential edge portion (i.e., the portion tending to cause the electric-field concentration) of electrode surface of the cold cathode 9 are blocked to suppress a degradation of electric current and a phenomenon of electric discharge at the outer circumferential edge portion, as compared with the case that the focusing electrode 16 is not provided (for example, the case of FIG. 3). Moreover, the electron-flow region is controlled to be focused so that the electron spot in the anode 11 is smaller. That is, since the electron-flow region between the cold cathode 9 and the anode 11 is further focused by the electron-focusing electrode 16, also the electron spot in the anode 11 becomes further smaller and comes to have a further even distribution. Accordingly, a further high electric current density can be obtained.

For example, as shown in FIG. 4, a voltage for the focusing electrode 16 was set at an approximately half value of a voltage between the cold cathode 9 and the anode 11, by using two power sources 12*a* and 12*b* (e.g., +20~+30 kV) and by applying a cold cathode including the carbon film structure formed by the technique shown in the above-mentioned Patent Documents 1 and 2, as the cold cathode 9. As a result of this experimentation, it was verified that a diameter of the electron spot in the anode 11 can be made smaller than or equal to 2 mm.

FIRST EXAMPLE

Figure 5:
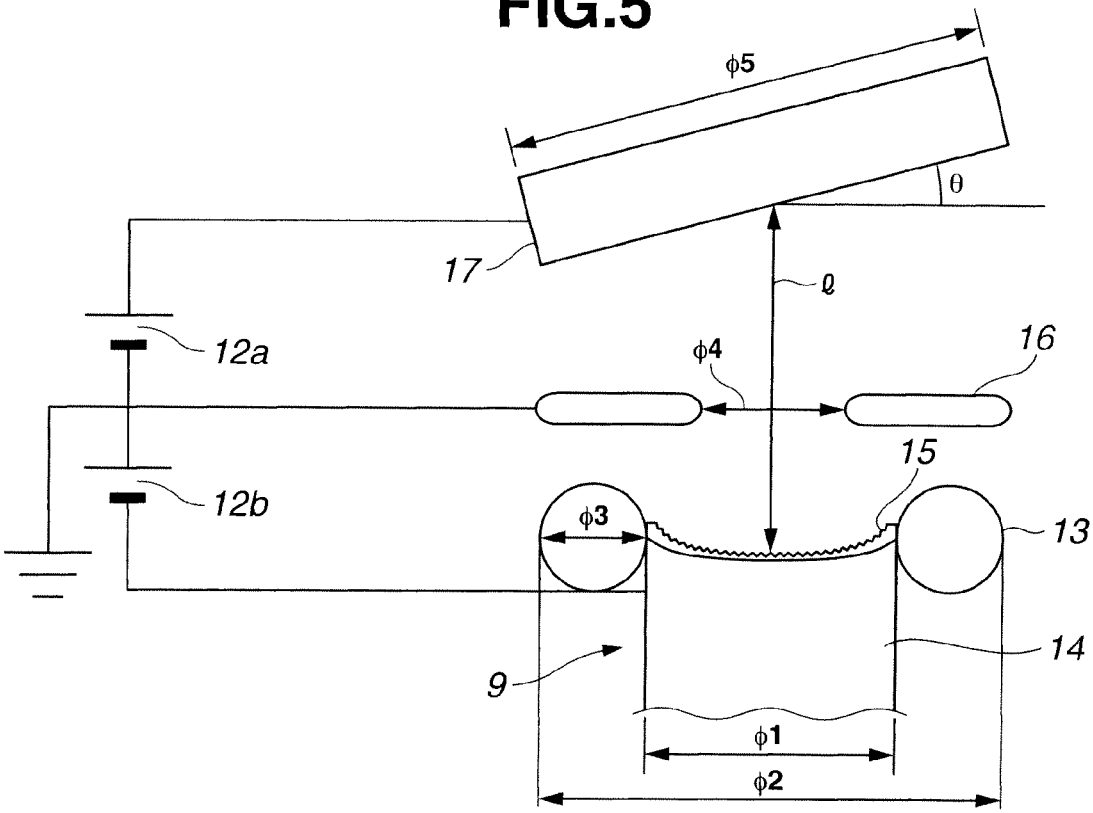
FIG. 5 A schematic explanatory view of an X-ray source in a first example.

FIG. 5 is a schematic view (electron beams are omitted from FIG. 5) for explaining one example in a case that the third embodiment is applied to an X-ray source. In FIG. 5, an outer diameter Φ1 of substantially disc-shaped substrate 14 is equal to 6 mm (the outer circumferential edge portion of carbon film structure 10 has been ground, and the curved concave surface of middle portion of carbon film structure 10 has an outer diameter equal to 5 mm). Moreover, in FIG. 5, an outer diameter Φ2 of the ring-shaped guard electrode 13 is equal to 12 mm. An outer diameter Φ3 of the cross section of guard electrode 13 is equal to 3 mm. An inner diameter Φ4 of the opening hole portion 16*a* of the substantially ring-shaped focusing electrode 16 falls within a range from 2 mm to 4 mm. An outer diameter Φ5 of substantially disc-shaped anode 17 falls within a range from 10 mm to 20 mm. A distance 1 between the cold cathode 9 and the anode 17 falls within a range from 18 mm to 20 mm (a distance between the cold cathode 9 and the focusing electrode 16 falls within a range from 3 mm to 8 mm). An inclination angle θ of the anode 17 falls within a range from 10° to 20°. A positional relation among the cold cathode 9, the focusing electrode 16 and the anode 17 satisfies the following formula.

Positional relation rate $L$=[Distance between Cold cathode and Focusing electrode]/[Distance between Cold cathode and Anode]=0.15~about 0.44

A cold cathode including the carbon film structure formed by the technique shown in the above-mentioned Patent Documents 1 and 2 was applied as the cold cathode 9 to the X-ray source constructed as shown by FIG. 5. As a result of this experimentation, it was verified that an electric current density higher than or equal to 100 mA/cm$^2$ (which is a level of electric current density necessary as an X-ray source) can be obtained. Also, it was verified that a deterioration with time passage in the structure shown in FIG. 5 is small sufficiently to continue a practical use.

It was verified that the equivalent result can be obtained also in a case that the positional relation rate L is set outside the range of 0.15~ about 0.44, for example, even in a case that the positional relation rate L falls within a range from 0.1 to 0.5. However, when the positional relation rate L is excessively low or excessively high, there is a risk that an unintended electric-discharge phenomenon, a breakage of the cold cathode or the like is caused.

Moreover, it was verified that the similar result can be obtained in a case that a depth of the concave surface in one side of substrate 14 onto which the carbon film structure 10 is formed falls within a range about from 0.5 mm to 0.8 mm.

Moreover, in a case that a shape of steel frame buried in concrete is inspected by the above-mentioned X-ray source, or in a case that the number of steel frames buried in concrete is inspected by the above-mentioned X-ray source, it was verified that a proper inspection can be achieved, for example, by setting the voltage between the cold cathode 9 and the anode 17 at 200 kV (and by setting the voltage between the cold cathode 9 and the focusing electrode 16 at 30 kV) and by setting the electric current at 100 mA.

Furthermore, in a case that a faulty weld of an inspection line or the like is inspected, in a case that a commonly-used component such as a metal electrode portion inside a high-pressure glass is inspected, in a case that the inside of an electric product is inspected, and the like, it was verified that a proper inspection can be achieved, for example, by setting the voltage between the cold cathode 9 and the anode 17 at 60 kV (and by setting the voltage between the cold cathode 9 and the focusing electrode 16 at 20~30 kV) and by setting the electric current at 5~10 mA.

SECOND EXAMPLE

Figure 6:
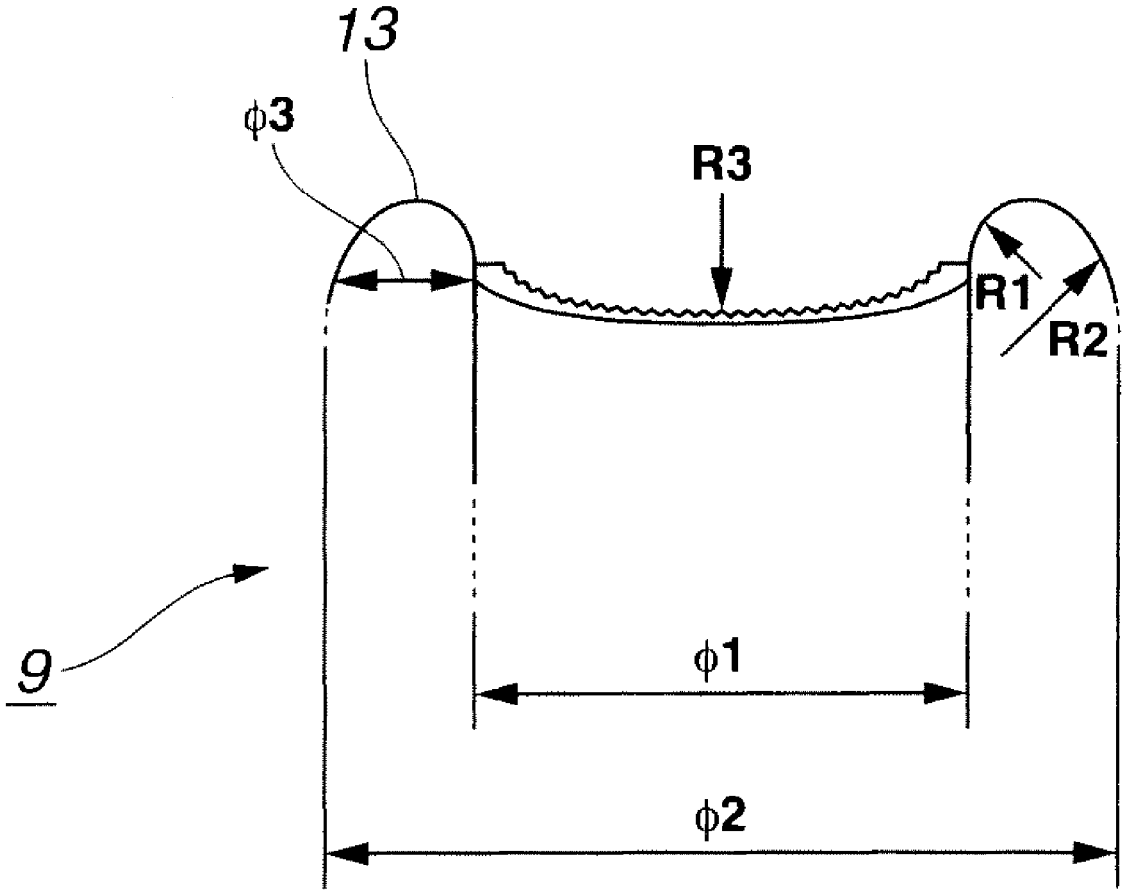
FIG. 6 A schematic explanatory view of a cold cathode in second and third examples.
Figure 7:
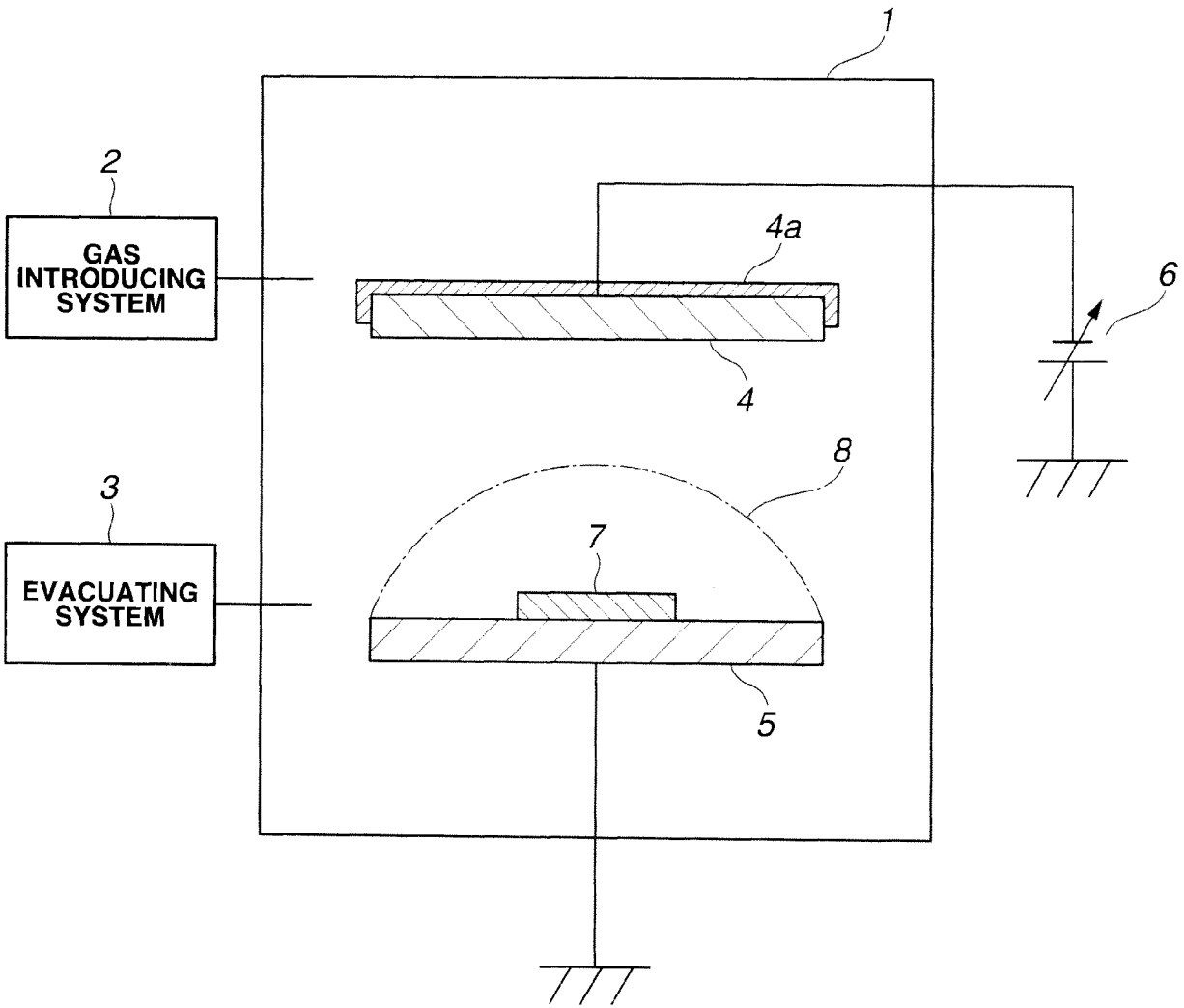
FIG. 7 A schematic explanatory view of a plasma CVD method for forming a carbon film structure.

A structure of a second example is similar as the structure of the first example. However, the cold cathode 9 having a structure as shown in FIG. 6 was employed. In the cold cathode 9 according to the second example, a curvature radius R3 of substrate 14 falls within a range from 8.3 mm to 8.5 mm, the outer diameter Φ1 of substrate 14 is equal to 6 mm (the outer circumferential edge portion of carbon film structure 10 has been ground, and the curved concave surface of middle portion of carbon film structure 10 has an outer diameter equal to 5 mm), the outer diameter Φ2 of the guard electrode 13 is equal to 12 mm, the curvature radius R1 of guard electrode 13 taken at its point located on the side of carbon film structure 10 is equal to 1 mm, and the curvature radius R2 of guard electrode 13 taken at its point located on the outer circumferential side is equal to 2 mm.

Then, a cold cathode including the carbon film structure formed by the technique shown in the above-mentioned Patent Documents 1 and 2 was applied to the structure according to the second example, as the cold cathode 9. As a result of this experimentation, it was verified that the result similar as the first example can be obtained.

THIRD EXAMPLE

A structure of a third example is similar as the structure of the second example. The cold cathode 9 having the structure as shown in FIG. 6 was employed. In the cold cathode 9 according to the third example, the curvature radius R3 of substrate 14 is equal to 25 mm, the outer diameter Φ1 of substrate 14 is equal to 16 mm (the outer circumferential edge portion of carbon film structure 10 has been ground, and the curved concave surface of middle portion of carbon film structure 10 has an outer diameter equal to 14.6 mm), the outer diameter Φ2 of the guard electrode 13 is equal to 36 mm, the inner diameter Φ4 of opening hole portion 16*a* of the focusing electrode 16 falls within a range from 8 mm to 12 mm, the curvature radius R1 of guard electrode 13 taken at its point located on the side of carbon film structure 10 is equal to 2 mm, and the curvature radius R2 of guard electrode 13 taken at its point located on the outer circumferential side is equal to 8 mm.

Then, a cold cathode including the carbon film structure formed by the technique shown in the above-mentioned Patent Documents 1 and 2 was applied to the structure according to the third example, as the cold cathode 9. As a result of this experimentation, it was verified that the result similar as the first example can be obtained.

As explained above, according to the present invention, in an emitter of field-emission electron that includes the carbon film structure, the localized electric-field concentration can be suppressed so that the electric-current degradation or the electric-discharge phenomenon due to thermal degradation can be prevented from occurring. Moreover, the dispersion (scattering) of electron emission can be suppressed.

Moreover, a field emission device to which the above-mentioned emitter is applied can achieve a desired function. Therefore, more practical products can be provided.

Hereinabove, the detailed explanations have been given to only the above-described concrete examples according to the present invention. However, it is obvious for those skilled in the art to make various variations and modifications of the above examples in light of the technical ideas according to the present invention. Such variations and modifications are within scopes of the following claims as a matter of course.

LIST OF REFERENCE SIGNS

7, 14 - - - Substrate
9 - - - Cold cathode
10, 15 - - - Carbon film structure
11, 17 - - - Anode
12, 12*a*, 12*b* - - - Power source
13 - - - Guard electrode
1 16 - - - Focusing electrode

The invention claimed is:

1. An electron emitter comprising:

a carbon film structure formed on a surface of a substrate, wherein the carbon film structure includes a plurality of acute shapes dispersed in the carbon film structure, wherein each of the acute shapes is formed by multilayered graphene sheets to have an inside hollow portion and has a radius reduced more toward a tip of the each acute shape; and a guard electrode provided at an outer circumferential edge portion of the carbon film structure such that the guard electrode has an electric potential equivalent to the carbon film structure, wherein the guard electrode includes a curved surface portion convex in a film-forming direction of the carbon film structure.

2. The electron emitter as claimed in claim 1, wherein a top portion of the curved surface portion of the guard electrode protrudes in the film-forming direction beyond an outer circumferential edge portion of the carbon film structure.

3. The electron emitter as claimed in claim 1, wherein the surface of the substrate on which the carbon film structure is formed is formed in a concave shape.

4. A field emission device comprising:

a cold cathode including the electron emitter as claimed in claim 1; and an anode disposed to cause an electrode surface of the anode to face an electrode surface of the cold cathode, wherein the field emission device is configured to emit electrons from the cold cathode by way of field emission, by applying a voltage between the cold cathode and the anode.

5. The field emission device as claimed in claim 4, wherein the field emission device further comprises a focusing electrode disposed between the cold cathode and the anode, and the focusing electrode is configured to introduce the electrons emitted from the cold cathode in a direction toward the anode and configured to focus an electron-flow region existing between the cold cathode and the anode.

6. The field emission device as claimed in claim 5, wherein the cold cathode, the anode and the focusing electrode are arranged to satisfy the following formula:

(a distance between the cold cathode and the focusing electrode)/(a distance between the cold cathode and the anode)=0.1~0.5.

7. An electron emitter comprising:

a carbon film structure formed on a surface of a substrate, wherein the carbon film structure includes a plurality of acute shapes dispersed in the carbon film structure, wherein each of the acute shapes is formed by multilayered graphene sheets to have an inside hollow portion and has a radius reduced more toward a tip of the each acute shape; and a guard electrode provided on an outer circumferential side of the carbon film structure, wherein the guard electrode is configured to have an electric potential equivalent to at least one of the carbon film structure and the substrate, wherein the guard electrode includes a curved surface portion convex in a film-forming direction of the carbon film structure, wherein the curved surface portion of the guard electrode has an outer-circumferential-side portion and a carbon-film-structure-side portion, and a curvature radius of the outer-circumferential-side portion is larger than a curvature radius of the carbon-film-structure-side portion.

8. The electron emitter as claimed in claim 7, wherein the guard electrode abuts the at least one of the carbon film structure and the substrate to have the electric potential equivalent to the at least one of the carbon film structure and the substrate.

* * * * *